United States Patent [19]

Dismukes

[11] 4,034,694

[45] July 12, 1977

[54] JIB FURLER

[76] Inventor: Newton Bradford Dismukes, 2952 Buttonwood Drive, Carrollton, Tex. 75006

[21] Appl. No.: 610,851

[22] Filed: Sept. 5, 1975

[51] Int. Cl.[2] ..... B63H 9/04
[52] U.S. Cl. ..... 114/106
[58] Field of Search ..... 114/104–107

[56] References Cited

U.S. PATENT DOCUMENTS

| | | | |
|---|---|---|---|
| 3,730,124 | 5/1973 | Britton | 114/106 |
| 3,789,790 | 2/1974 | Crall | 114/106 |
| 3,851,609 | 12/1974 | Stearn | 114/105 |
| 3,958,523 | 5/1976 | Holmes | 114/106 |

FOREIGN PATENT DOCUMENTS

| | | | |
|---|---|---|---|
| 1,407,662 | 9/1975 | United Kingdom | 114/106 |

*Primary Examiner*—Trygve M. Blix
*Assistant Examiner*—Gregory W. O'Connor

[57] ABSTRACT

The jib furler comprises an upper swivel system attached to a mast including a halyard sheave and a stay attachment device, a lower swivel system attached to a deck including attachment for a jib tack pendant, stay and halyard; and a halyard, luff rope and stay tensioned between the upper and lower swivels. Rotation of the lower swivel transmits a torqueing force to the upper swivel through the tensioned halyard and luff rope whereby the jib sail may be furled around the stay, luff rope and halyard without appreciable twisting of the stay. The jib is hanked directly upon the stay so that jibs may be changed without disturbing mast security which is sustained by the taut stay during sail changes.

12 Claims, 7 Drawing Figures

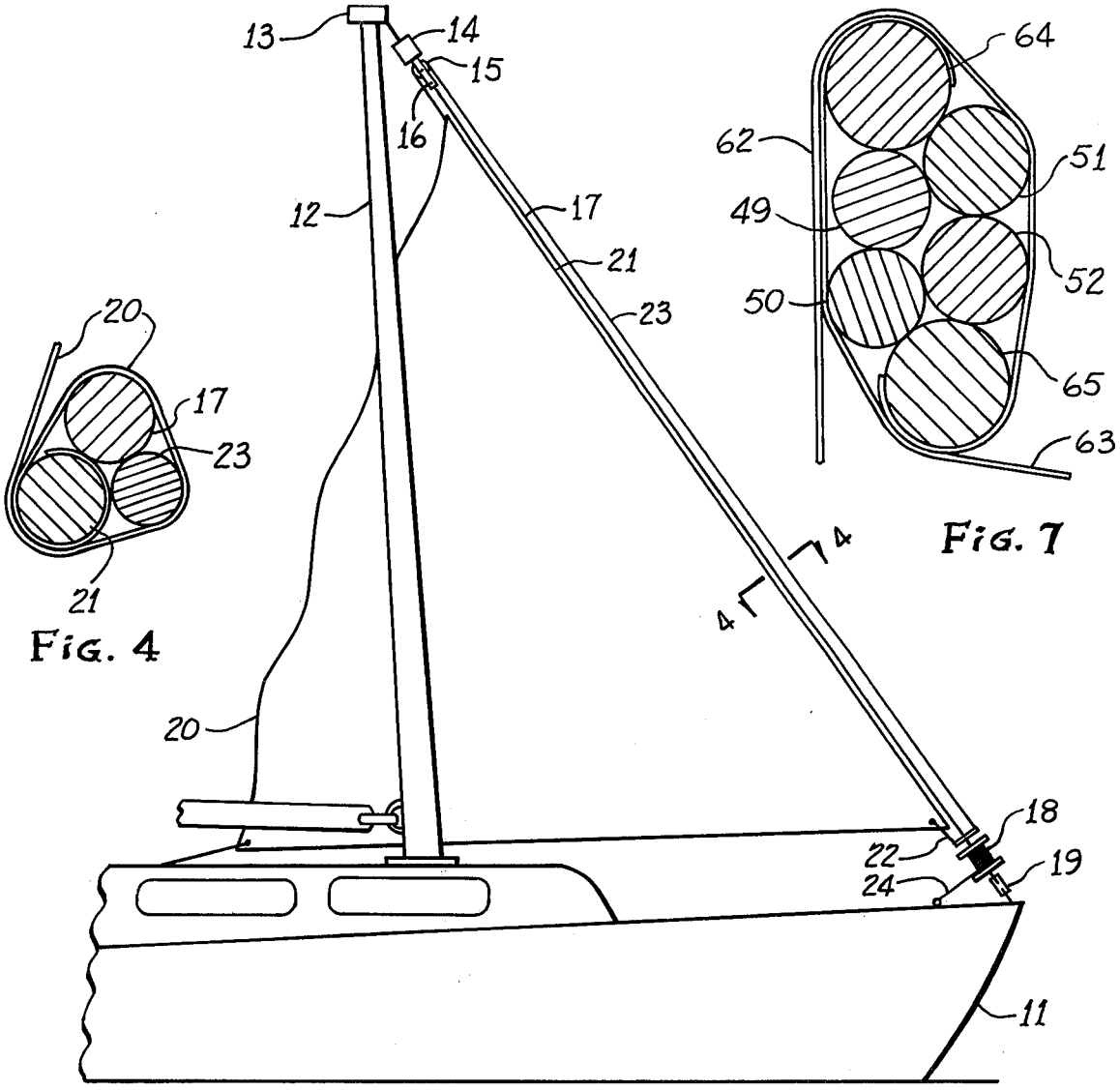
Fig. 1
Fig. 7
Fig. 4
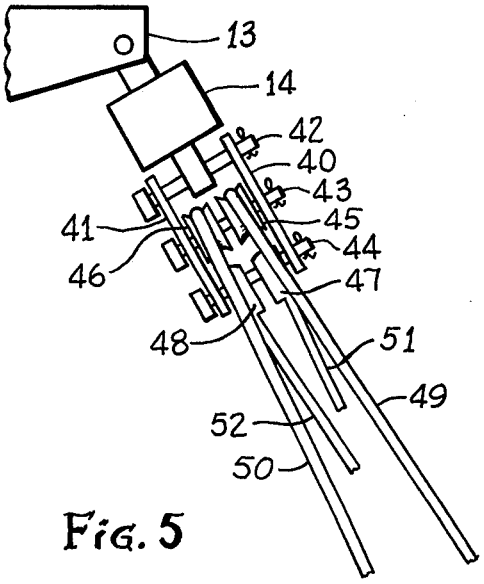
Fig. 5
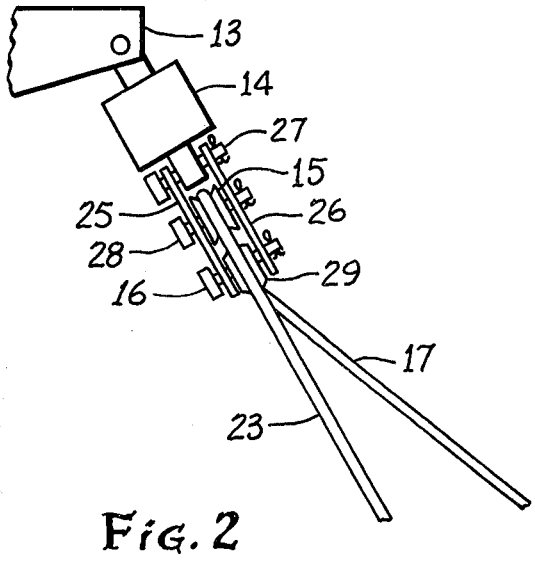
Fig. 2

JIB FURLER

BACKGROUND OF THE INVENTION

This invention relates to an improvement in jib-furling carried out by rotation of apparatus spaced above the foredeck of a sailboat, and more particularly to winding a jib sail around its own luffrope and halyard and the forestay.

To furl or reef a jib sail by causing it to roll up around an apparatus in much the same manner as a window shade is not new. Common to most of the systems is an upper swivel near a masthead and a lower swivel, which usually includes a drum, near the deck at the bow of a sailboat. Generally the differences in present jib furling systems involve the kind of apparatus upon which the jib sail is wound. In one system the jib sail luffrope serves as the forestay also. The luffrope/forestay may be the usual 1 × 19 wire line or a solid length of metal. In any case, the jib sail cannot be changed without disconnecting the stay from the mast, a complicated operation which cannot be carried out while underway. In another furling system the upper and lower swivels are mounted to the mast and deck respectively somewhat aft of the forestay. The upper swivel is attached to the head of the jib and hoisted by means of the jib halyard with the jib tack pendant fixed to the lower swivel. In all except quite small sailboats it is almost impossible to get sufficient tension in the halyard to prevent serious loss of sail efficiency when close hauled. Still another system does not employ an upper swivel but uses spool sections rotatably mounted on a stay to support the tension of the jib sail luffrope and upon which the sail is furled. This system increases windage and jib sag when going to windward and is expensive. Another jib furling apparatus employs a stay having a C-shape and a third swivel means to prevent twisting of the halyard around the stay when the jib sail is furled. While each of the above arrangements can be used to furl a jib sail, each suffers from disadvantages which are overcome by the present invention. The several objects of the present invention include the ability to change jib sails while underway. Another object is to reduce jib sag and the resultant loss of sail efficiency when sailing close hauled. Other objects include the absence of complicated apparatus, the use of existing jib sails and of time tested upper and lower swivels. Still another object is the obtention of an efficient sail shape when the sail is partially furled. These and other features and objectives will become more apparent from the drawings and from the declarations which follow.

SUMMARY OF THE INVENTION

In the present invention the forestay system includes an upper swivel attached to the masthead, the wireline forestay itself and a lower swivel and drum connected to the foredeck by means of a turnbuckle. A sheave for the jib sail halyard is incorporated into the upper swivel. The lower swivel includes a means for tying off the lower end of the jib halyard and for attaching a jib sail tack pendant. Rotation of the lower swivel causes an almost instantaneous rotative movement of the upper swivel due to the tautness of the three lines (luffrope, jib halyard and forestay) between the two swivels. This results in a smooth furling of the jib sail throughout its entire length thus contributing to an aerodynamically efficient sail shape. The jib sail may be hanked onto the forestay by any convenient means, however, the use of snaps or other means which will not cause lumps along the luff of the furled sail, is preferred. The jib sail may be raised or lowered on the forestay by means of the halyard which passes over the sheave in the upper swivel, hence sail changes may be made while underway. The relative amount of tension between the halyard and forestay is adjusted when the jib sail is hoisted. However, the final tensions are controlled by the turnbuckle or similar device as is usual.

In another embodiment of the invention, twin forestays are suspended between the upper and lower swivels which, together with two upper sheaves and dual means for attaching jib sail tack pendants and halyards to the lower swivel, permit two headsails to be flown simultaneously. The two sails may be reefed or furled at the same time, or each may be hoisted or lowered individually. Of course, a single standard jib sail may be hanked onto one or both of the forestays, preferably the latter, and furled as described hereinbefore. The additional lines between the swivels create no problems, but on the contrary contribute to an even more efficient shape of a partially furled sail and tend to reduce further any sag of the jib sail when going to windward.

BRIEF DESCRIPTION OF THE DRAWING

FIG. 1 is a schematic partial side elevational view of the forward portion of a sailboat employing the improved jib furler as disclosed and described herein.

FIG. 2 is a side view of an upper swivel assembly, including a sheave, employed in the furling apparatus shown in part in FIG. 1

FIG. 4 is a sectional view taken on line 4—4 of FIG. 1 showing a jib sail, a forestay, a jib halyard and a jib sail luffrope at the time when the jib sail has been furled one rotative turn of the lower swivel.

FIGS. 5, 6, and 7 show views similar to FIGS. 2, 3, and 4 for the second embodiment of the invention which employs twin headsails.

Corresponding reference characters indicate corresponding parts throughout the several views of the drawings.

DESCRIPTION OF THE PREFERRED EMBODIMENT

Figure 3:
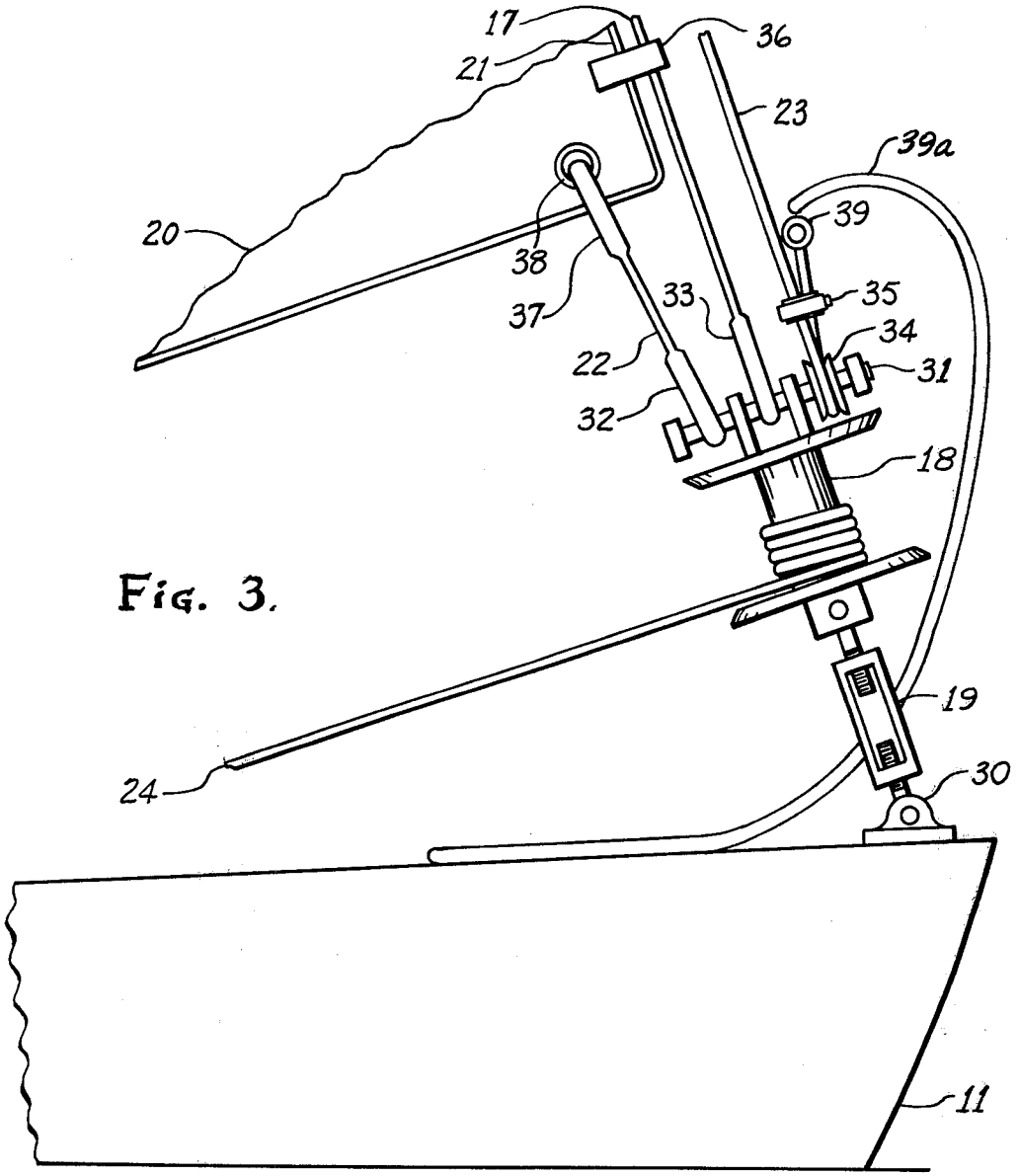
FIG. 3 is a side elevational view of a lower swivel assembly, including means for attaching a jib sail tack pendant and a forestay and a means for tying off a jib halyard, all as employed in the present invention.

Referring now to the preferred embodiment, FIG. 1 shows a sailboat 11 fitted with a mast 12 having a masthead 13 with a swivel 14 attached thereto. Said swivel includes a halyard sheave 15 and a forestay fastener 16, to which is attached stay 17. Lower swivel 18 is attached to the boat foredeck by turnbuckel 19. A jib sail indicated at 20 has a luffrope 21 and a tack pendant 22 attached to swivel 18. Luffrope 21 is attached to halyard 23 which after passing around sheave 15 is tied off to swivel 18. Rotation of a lower swivel 18 as by manipulation of control line 24 causes essentially immediate rotation of upper swivel 14 because stay 17, luffrope 21 and halyard 23, all being quite taut and slightly spaced apart resisting twisting around each other sufficiently to impart a strong torque to the upper swivel 14. Thus jib sail 20 is caused to wrap around stay, luffrope and halyard throughout its entire length. Continued rotation of swivel 18 furls the jib sail evenly and smoothly.

As is well known in the art lower swivels usually incorporate a drum arrangement whereby a jib sail is furled by unwinding a line such as line 24 from the drum. The jib sail is unfurled by releasing line 24 and pulling on a jib sheet with an assist from the wind, if any. Any portion of the jib sail may be furled or unfurled depending upon the amount of line allowed to remain on the swivel drum.

FIG. 2 shows an upper swivel assembly wherein swivel 14 is connected to two metal straps 25 and 26 by means of pin 28. Marine eye 29 connects stay 17 to straps 25 and 26 by means of a pin fastener 16.

As is also known in the art, a solid or hollow metal extrusion, often shaped to improve aerodynamic efficiency, may be substituted for the usual wire line forestay. Such a substitution of metal or other material is contemplated herein.

FIG. 3 shows the lower swivel assembly from an athwartship view wherein bow fitting 30 connects turnbuckle 19 to the foredeck of sailboat 11. Shown in more detail that in FIG. 1 is the swivel 18 which incorporates a drum for handling control line 24. Pin 31 attaches tack pendant 22 by means of a marine eye fitting 32. A second eye fitting 33 attaches forestay 17 to pin 31. The lower portion of jib halyard 23 passes around sheave 34 and is tied off to itself by means of a wire line clamp 35. Jib snaps 36 attach jib sail 20 to forestay 17 while shackle 37 connects tack pendant 22 to sail tack 38. The thimble 39 is used to attach an auxiliary line, 39*a*, used to hoist or lower jib sail 20.

With reference to FIGS. 1, 2 and 3, the improved jib furler is installed by connecting the upper swivel assembly shown in FIG. 2 to the masthead 13, first making sure that forestay 17 is attached thereto and that halyard 23 has been passed over sheave 15, also that an auxiliary line has been made fast to thimble 39. The lower end of forestay 17, tack pendant 22 and sheave 34 are attached to swivel 18 by pin 31 and the lower swivel assembly is fixed to the foredeck by means of turnbuckle 19 and bow fitting 30. The turnbuckle is open sufficiently to allow slack in the stay 17 but still support mast 12 which possibly has been allowed to rake aft a few inches. The jib sail 20 is raised, after fastening snaps 36 around forestay 17, by pulling the auxiliary line sufficiently to station halyard 23 around sheave 34 and to fasten wire line clamp 35. Jib sail tack 38 is downhauled enough to connect shackle 37. Final tensioning of stay 17 and halyard 23 is accomplished by tightening turnbuckle 19. Distribution of tension between the stay and halyard may be adjusted by repositioning the halyard in wire line clamp 35. Of course, the forestay must be of proper length and the upper and lower swivels sufficiently strong to be able to support the heavy tensional loads to be encountered later and still rotate without undue friction. Jib sails are changed in the same manner whether in harbor or underway. Simply attach an auxiliary line to thimble 39, release wire rope clamp 35, lower the unfurled sail and unsnap the hanks 36. The new sail is attached to halyard 23, raised and made fast as described in the preceding paragraph. To assist sail change, turnbuckle 19 may be opened slightly before releasing clamp 35 and later tightened to complete the sail change operation. It should be clear that the mast is secure at all times during sail change because the stay is never disconnected.

An incidental benefit from use of my improved jib furler is that it provides an additional halyard. Many stock sailboats need but do not have a spare halyard. Release of the existing jib haylard from regular duty permits it to be used to hoist a sleevelike sail cover around a furled jib to protect it from the elements.

DESCRIPTION OF THE SECOND EMBODIMENT

Figure 6:
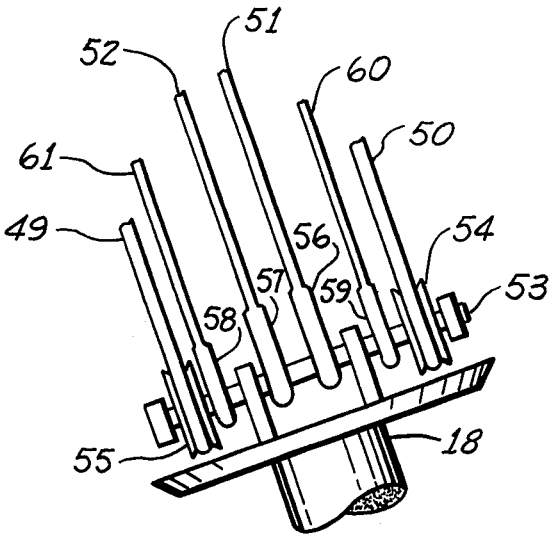

FIGS. 5, 6 and 7 refer to the embodiment adapted for use with twin head sails. This involves elongation of supporting pin members. In FIG. 5 two metal straps 40 and 41 are attached to upper swivel 14 by elongated pin 42 while pins 43 and 44 support sheaves 45 and 46 and eyes 47 and 48 respectively. Halyards 49 and 50 pass over sheaves 45 and 46. Stays 51 and 52 are fixed to eyes 47 and 48. FIG. 6 shows swivel 18 fitted with elongated pin 53, sheaves 54 and 55, and two eyes 56 and 57 attached to stays 51 and 52 and two additional marine eyes 58 and 59 connected to jib tack pendants 60 and 61. FIG. 7 is similar to FIG. 4 and shows an enlarged cross sectional view of twin head sails 62 and 63 having luffropes 64 and 65 at a time when furling has just begun. Because the twin head sails are furled simultaneously, about equal areas of each sail remains unfurled at a given time thus providing balanced downward performance. As when furling a single sail, twin head sails may be furled from the safety of the cockpit. Twin head sails are used most frequently when sailing down wind in uncongested waters. When these conditions change, each of the twin head sails may be lowered individually and a jib or genoa head sail hoisted. It is preferable to hank the new sail onto both stays 51 and 52 to reduce sag when sailing close hauled and to provide a better shape if the sail is reefed.

In view of the foregoing it is apparent that several objects of this invention are achieved and that other advantages will become clear to those skilled in the art.

What is claimed is:

1. In a sailboat carrying a jib sail an improved jib furler apparatus rotatably spaced between an upper swivel attached to a mast and a lower swivel attached to a deck comprising:

a wire line stay
means for attaching said stay to said upper swivel
means for attaching said stay to said lower swivel
a halyard
means for attaching said halyard to said upper swivel
means for attaching said halyard to said lower swivel
means for selectively rotating said lower swivel whereby said jib is furled around said stay and halyard.

2. In a sailboat carrying twin head sails, an improved jib furler apparatus spaced between an upper swivel attached to a mast and a lower swivel attached to a deck comprising:

two stays;
means for attaching said stays to said upper swivel;
means for attaching said stays to said lower swivel;
two halyards;
means for attaching said halyards to said upper swivel;
means for attaching said halyards to said lower swivel;
means for selectively rotating said lower swivel whereby said twin head sails are furled around said stays and halyards.

3. An improved jib furler according to claim 2 wherein said lower swivel halyard attachment means is releasably attached to said lower swivel.

4. An improved jib furler according to claim 2 including means for attaching two jib tack pendants to said lower swivel.

5. An improved jib furler according to claim 2 and including means for adjusting tension in said stays.

6. An improved jib furler according to claim 2 wherein said stays are a shaped solid material.

7. An improved jib furler apparatus comprising:

an upper swivel assembly including and rotative therewith a halyard attachment means a stay attachment means below said halyard attachment means a lower swivel assembly including and rotative therewith a stay attachment means a halyard attachment means a jib tack pendant attachment means means to selectively rotate said lower swivel assembly a stay a halyard a jib luff rope whereby a rotary force applied to said lower swivel is transmitted by said halyard and jib luff rope to said upper swivel assembly without substantial twist of said stay.

8. An improved jib furler according to claim 7 including a means to simultaneously tension said stay, halyard and luff rope.

9. An improved jib furler according to claim 7 including a jib sail hanked directly to said stay.

10. An improved jib furler according to claim 7 including a jib sail adapted to be furled directly around said stay, halyard and luff rope.

11. An improved jib furler according to claim 10 wherein said halyard and luff rope are spaced apart sufficiently to prevent twist of said stay when said sail is furled.

12. The method of changing from a first roller furling jib to a second jib while underway, so that mast security is maintained at all times by the stay, comprising the steps of:

providing an upper swivel assembly containing a haylard sheave, a lower swivel assembly including a releaseable halyard attachment means, a jib sail including stay attachment means and an auxiliary line attaching said auxiliary line to said halyard releasing said halyard from said lower swivel passing said halyard over and around said halyard sheave to lower said first jib and hoisting said second jib.

* * * * *